US007494249B2

(12) United States Patent
Li

(10) Patent No.: US 7,494,249 B2
(45) Date of Patent: Feb. 24, 2009

(54) MULTIPLE-SET HEAT-DISSIPATING STRUCTURE FOR LED LAMP

(75) Inventor: Jia-Hao Li, Kao Hsiung Hsien (TW)

(73) Assignee: Jaffe Limited, Tortola (VG)

( * ) Notice: Subject to any disclaimer, the term of this patent is extended or adjusted under 35 U.S.C. 154(b) by 77 days.

(21) Appl. No.: 11/428,827

(22) Filed: Jul. 5, 2006

(65) Prior Publication Data

US 2008/0007955 A1 Jan. 10, 2008

(51) Int. Cl.
*F21V 29/00* (2006.01)

(52) U.S. Cl. ..... 362/294; 362/345; 362/373; 362/800

(58) Field of Classification Search ..... 362/294, 362/96, 264, 373, 345, 580, 547, 800; 165/80.2, 165/80.3, 80.4
See application file for complete search history.

(56) References Cited

U.S. PATENT DOCUMENTS 3,739,234 A * 6/1973 Bylund et al. ..... 257/715
3,792,318 A * 2/1974 Fries et al. ..... 257/715
4,729,076 A * 3/1988 Masami et al. ..... 362/235
5,396,947 A * 3/1995 Itoh ..... 165/104.14
5,852,339 A * 12/1998 Hamilton et al. ..... 313/11
6,435,266 B1 * 8/2002 Wu ..... 165/80.3
6,897,486 B2 * 5/2005 Loh ..... 257/81
6,910,794 B2 * 6/2005 Rice ..... 362/547
7,011,431 B2 * 3/2006 Ono et al. ..... 362/241
7,198,386 B2 * 4/2007 Zampini et al. ..... 362/294
7,270,446 B2 * 9/2007 Chang et al. ..... 362/294
2007/0279862 A1 * 12/2007 Li ..... 361/692
2007/0279909 A1 * 12/2007 Li ..... 362/294
2008/0007954 A1 * 1/2008 Li ..... 362/294

* cited by examiner

*Primary Examiner*—Sandra L. O'Shea
*Assistant Examiner*—Gunyoung T. Lee

(57) ABSTRACT

A multiple-set heat-dissipating structure for a LED lamp for performing the heat dissipation of the LED set includes a heat-conducting base, a plurality of heat pipes and a plurality of heat-dissipating bodies. On end face of the heat-conducting base is used for adhering to and contacting with the LED set. Each heat pipe has a heat-absorbing end and a heat-releasing end, respectively. The heat-absorbing end is connected to the other end face of the heat-conducting base. Each heat-dissipating body has a hollow cylinder. The outer periphery of the cylinder is formed with a plurality of radial heat-dissipating pieces and is connected on the heat-releasing end of each heat pipe. By dispersing each heat pipe and heat-dissipating body, the heat generated by the operation of the LED set can be conducted and dissipated by each heat pipe and heat-dissipating body at multiple points. In this way, the LED set can be continuously operated under a suitable working temperature and thus its life can be elongated.

7 Claims, 8 Drawing Sheets

MULTIPLE-SET HEAT-DISSIPATING STRUCTURE FOR LED LAMP

BACKGROUND OF THE INVENTION

1. Field of the Invention

The present invention relates to a multiple-set heat-dissipating structure for a LED lamp, and in particular to a multiple-set heat-dissipating structure for performing the heat dissipation of the LED lamp.

2. Description of Prior Art

Since light-emitting diodes (LED) are high-intensity, energy-saved and long-life, they are widely used in the illumination of electronic devices or lamps. Further, in order to increase the illuminating range and intensity thereof, a plurality of light-emitting diodes are usually combined to form a LED set. However, with the subsequent development of increasing number of light-emitting diodes and high-power light-emitting diodes, the heat generated by the operation of the light-emitting diodes is inevitably increasing. Therefore, it is an important issue for those skilled in this art to provide a heat-dissipating structure for LED lamps.

As shown in FIGS. 1 and 2, the conventional heat-dissipating structure for the LED lamp mainly comprises a heat pillar 10*a* and a heat-dissipating body 20*a* connected onto the heat pillar 10*a*. The bottom surface of the heat pillar 10*a* is used for adhering to and contacting with a LED set (not shown). The heat-dissipating body 20*a* has a hollow cylinder 21*a*. A plurality of heat-dissipating pieces 22*a* extend radially from the outer periphery of the cylinder 21*a*. With the above arrangement, a heat-dissipating structure for the LED lamp can be formed.

However, in practice, the conventional heat-dissipating structure for the LED lamp still has the following problems. The heat generated by the LED set is transferred to the outside only by single heat pillar 10*a*. Since the inner volume of the heat pillar 10*a* is large, it responds to the heat slowly, and thus the speed of transferring the heat to the outside will be greatly reduced. Further, in the heat transfer path, since the heat is transferred from the surface of the heat pillar 19*a* to the cylinder 21*a*, and then from the cylinder 21*a* to each heat-dissipating piece 22*a*, the heat received by each heat-dissipating piece 22*a* is gradually decreased from its root portion to the outer portion. The region other than the middle portion of each heat-dissipating piece 22*a* only occupies a limited space and thus is insufficient for the heat dissipation of the LED set. Therefore, in the above-mentioned heat-dissipating structure, the heat transferred by such structure is greatly restricted, so that the life of the light-emitting diodes in the LED set is reduced.

In view of the above, the inventor proposes the present invention to overcome the above problems based on his expert experiences and deliberate researches.

SUMMARY OF THE INVENTION

The present invention is to provide a multiple-set heat-dissipating structure for a LED lamp. By dispersing each heat pipe and heat-dissipating body, the heat generated by the operation of the LED set can be conducted and dissipated by each heat pipe and heat-dissipating body at multiple points. In this way, the LED set can be continuously operated under a suitable working temperature and thus its life can be elongated.

The present invention provides a multiple-set heat-dissipating structure for a LED lamp for the performing heat dissipation of the LED set, which comprises a heat-conducting base, a plurality of heat pipes and a plurality of heat-dissipating bodies. On end face of the heat-conducting base is used for adhering to and contacting with the LED set. Each heat pipe has a heat-absorbing end and a heat-releasing end, respectively. The heat-absorbing end is connected to the other end face of the heat-conducting base. Each heat-dissipating body has a hollow cylinder. The outer periphery of the cylinder is formed with a plurality of radial heat-dissipating pieces and is connected on the heat-releasing end of each heat pipe.

BRIEF DESCRIPTION OF THE DRAWINGS

The features of the invention believed to be novel are set forth with particularity in the appended claims. The invention itself however may be best understood by reference to the following detailed description of the invention, which describes certain exemplary embodiments of the invention, taken in conjunction with the accompanying drawings in which:

DETAILED DESCRIPTION OF THE INVENTION

The characteristics and the technical contents of the present invention will be described with reference to the following detailed description and the accompanying drawings. However, it should be understood that the drawings are illustrative but not used to limit the scope of the present invention.

Figure 1:
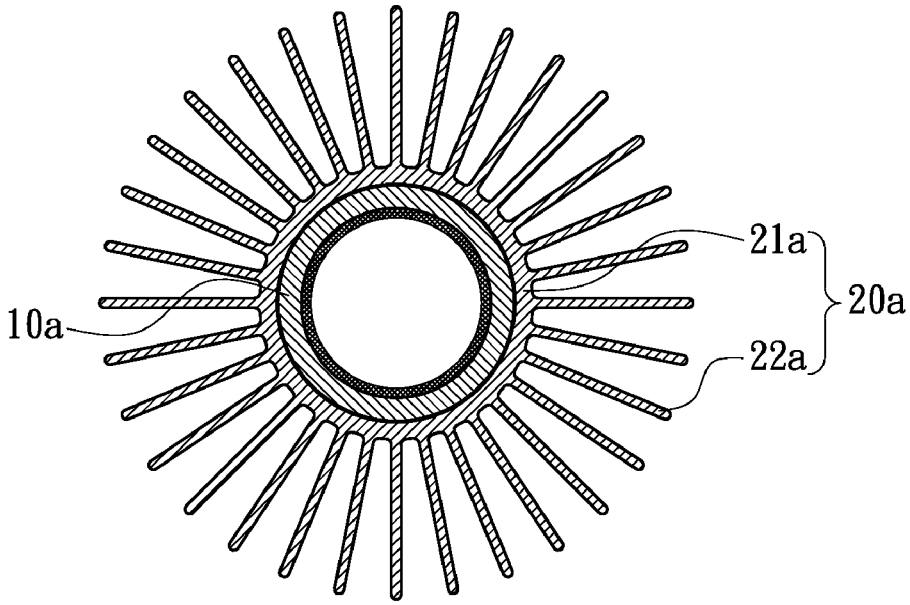
FIG. 1 PRIOR ART
FIG. 1 is a transverse cross-sectional view of a heat-dissipating structure for a LED lamp in prior art.
Figure 2:
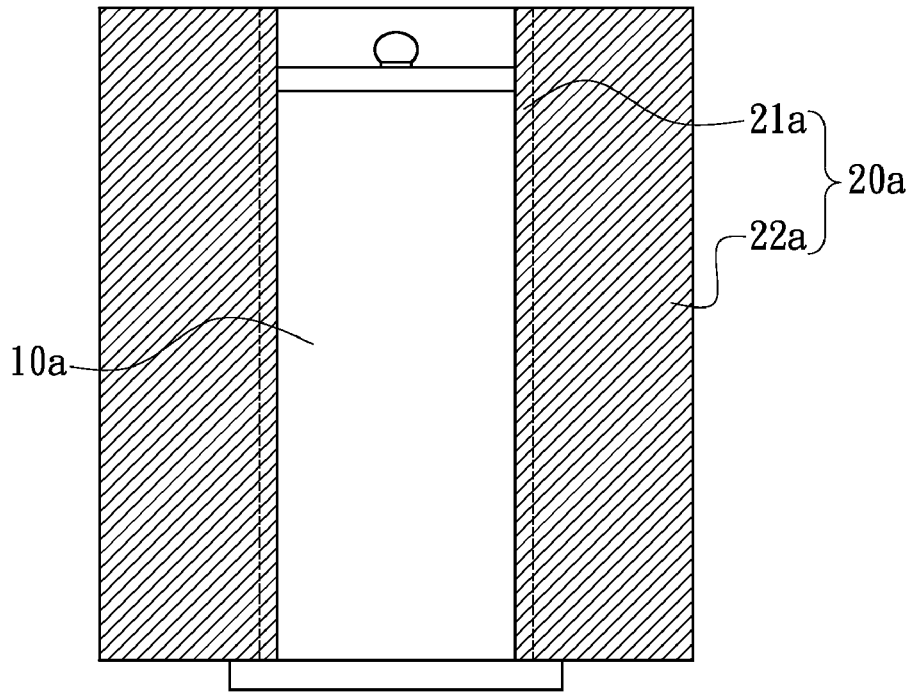
FIG. 2 PRIOR ART
FIG. 2 is a longitudinal cross-sectional view of a heat-dissipating structure for a LED lamp in prior art.
Figure 3:
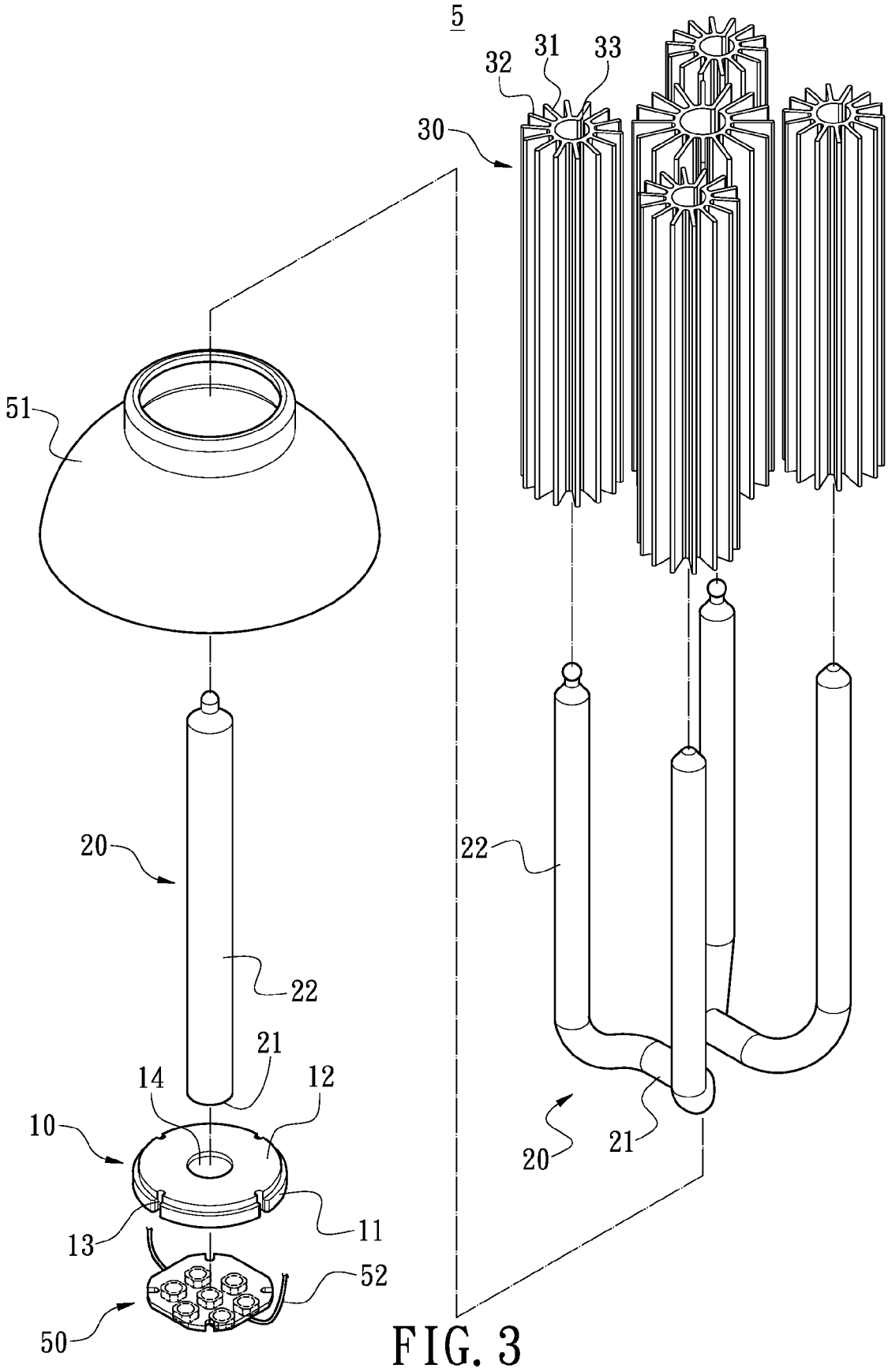
FIG. 3 is an exploded perspective view of the first embodiment of the present invention.
Figure 4:
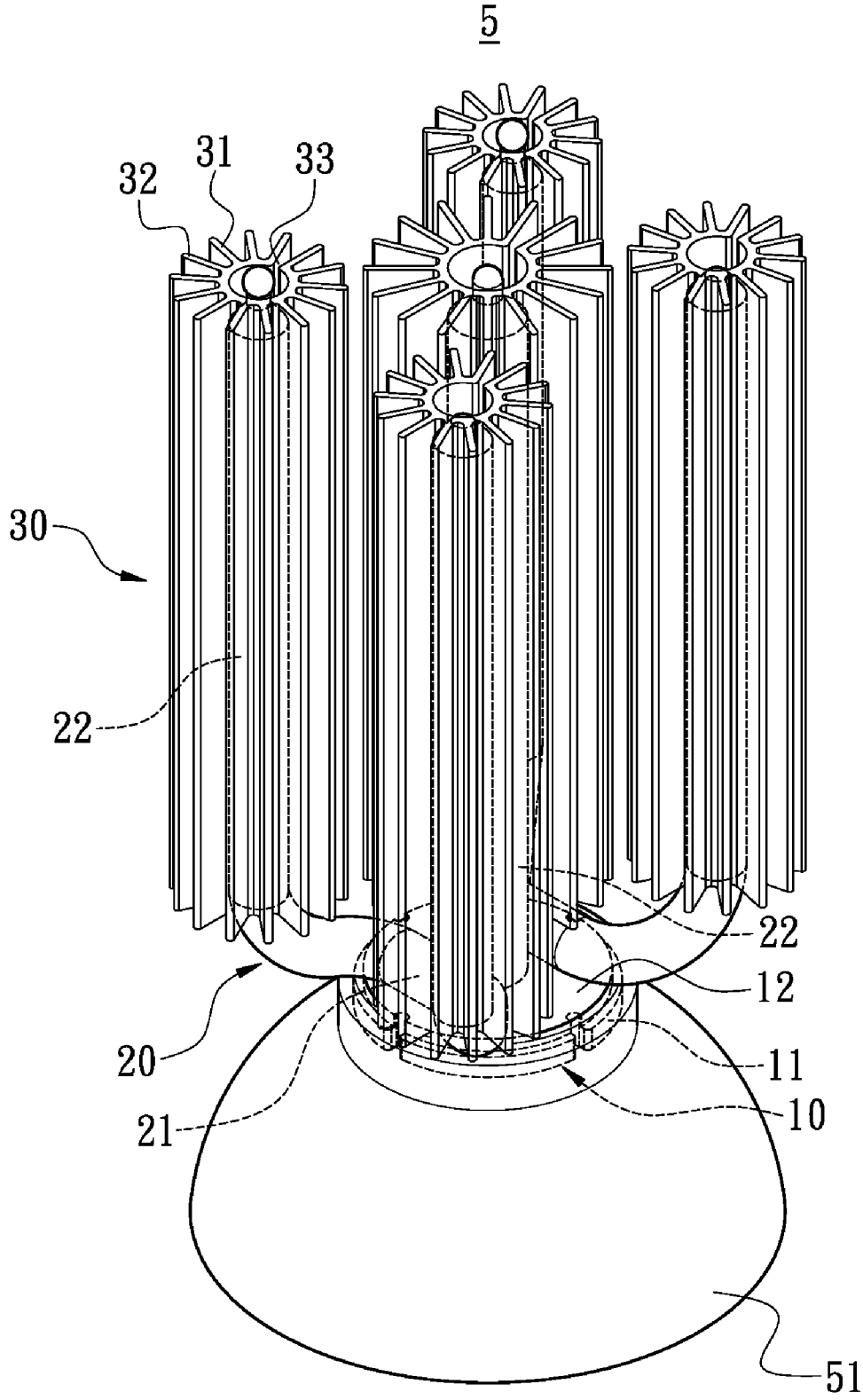
FIG. 4 is an assembled perspective view of the first embodiment of the present invention.
Figure 5:
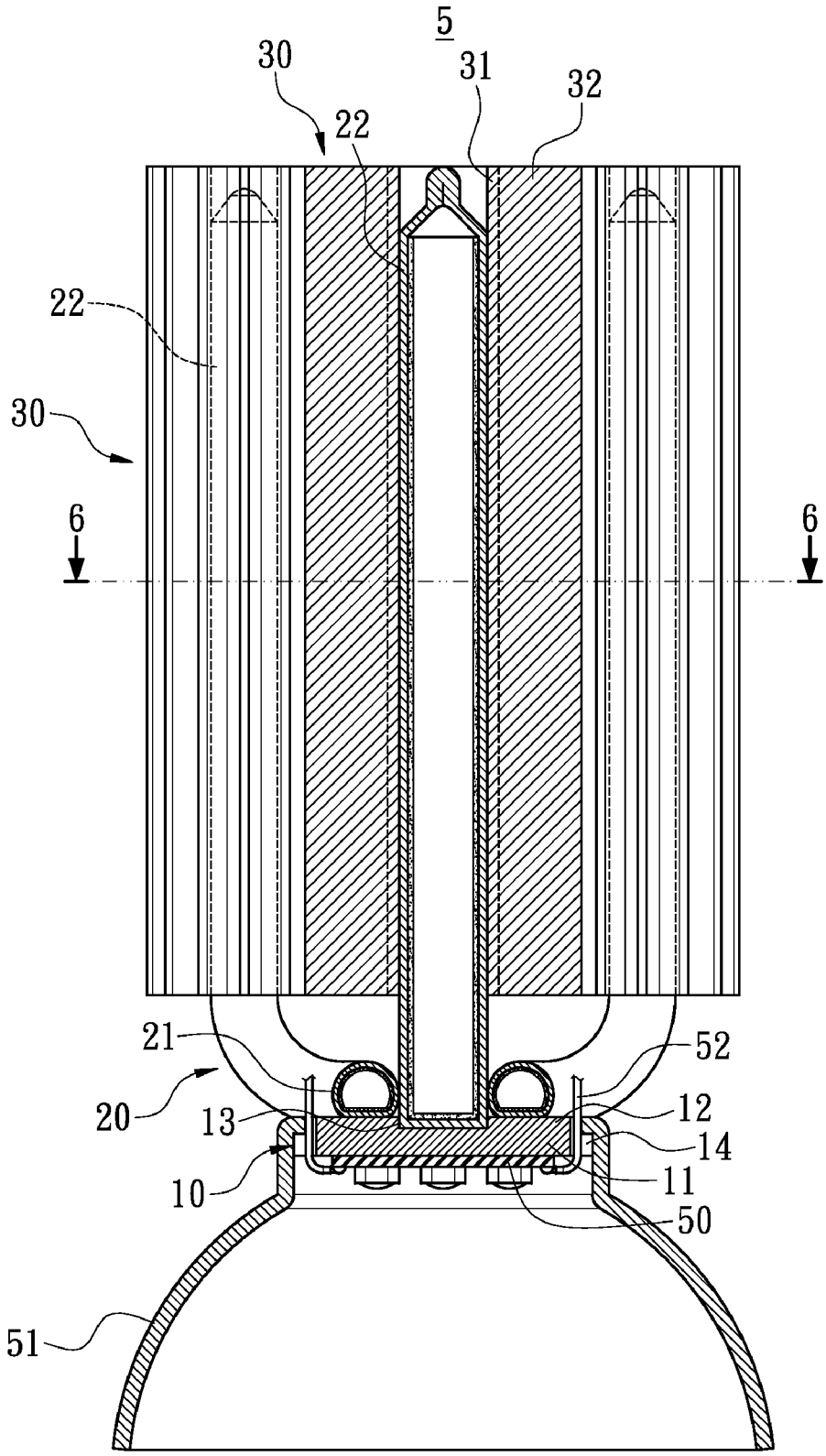
FIG. 5 is a longitudinal cross-sectional view showing the assembling of the first embodiment of the present invention.
Figure 6:
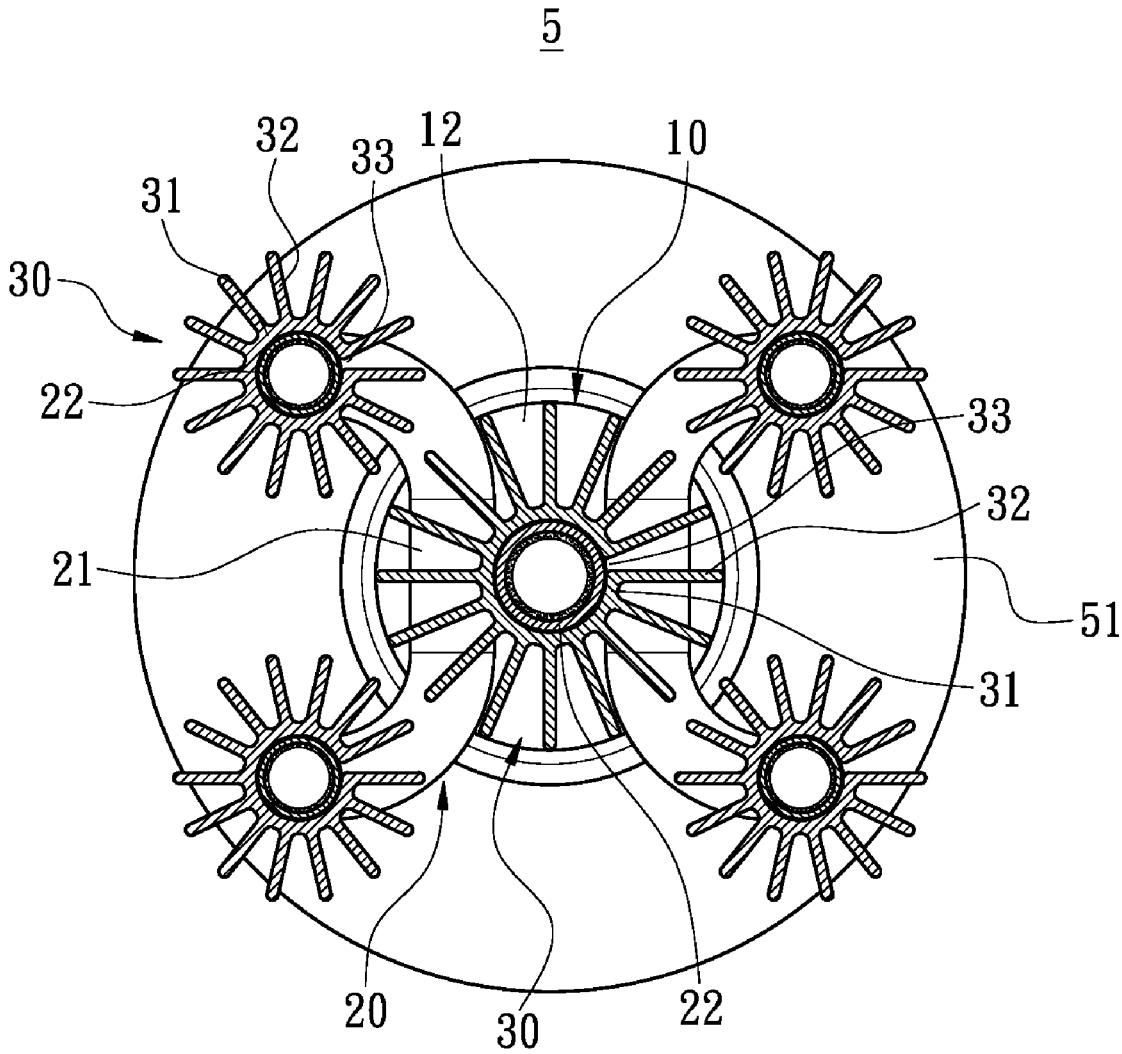
FIG. 6 is a cross-sectional view taken along the line 6-6 of FIG. 5.

FIG. 3 is an exploded perspective view of the first embodiment of the present invention. FIG. 4 is an assembled perspective view of the first embodiment of the present invention. FIG. 5 is a longitudinal cross-sectional view showing the assembling of the first embodiment of the present invention. FIG. 6 is a cross-sectional view taken along the line 6-6 of FIG. 5. The present invention provides a multiple-set heat-dissipating structure for a LED lamp for performing the heat dissipation of the LED set 50, which comprises a heat-conducting base 10, a plurality of heat pipes 20 and a plurality of heat-dissipating bodies 30.

The heat-conducting base 10 can be made of aluminum, copper or other materials having good heat conductivity and has a circular plate 11. A circular protruding plate 12 extends upwardly on the plate 11. The outer diameter of the circular protruding plate 12 is slightly smaller than that of the plate 11. Further, the outer peripheries of the plate 11 and the protruding plate 12 are recessed to form a plurality of symmetric notches 13. The center of the protruding plate 12 is provided with a circular accommodating hole 14.

The heat pipe 20 can be formed into an I-lettered, L-lettered, U-lettered shape or other different shapes. The outside of the heat pipe has a heat-absorbing end 21 and a heat-releasing end 22. The interior thereof is filled with the capillary structure and a working fluid. In the present embodiment, the heat pipe is constituted of one I-lettered heat pipe 20 and two U-lettered heat pipes 20. The heat-absorbing end 21 of the I-lettered heat pipe 20 is connected into the accommodating hole 14 of the heat-conducting base 10. The heat-absorbing end 21 of the U-lettered heat pipe 20 is used for adhering to and contacting with the top face of the protruding plate 12 of the heat-conducting base 10.

Figure 9:
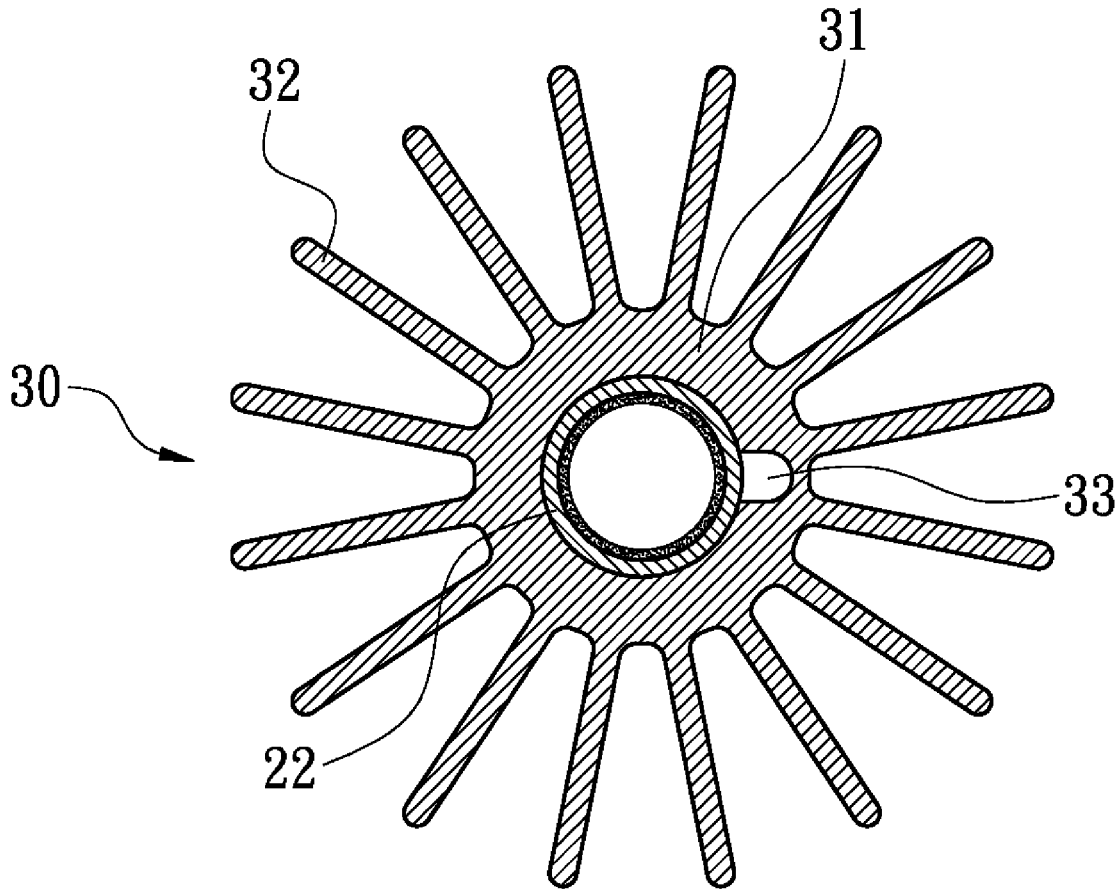
FIG. 9 is a cross-sectional view showing the assembling of the heat pipe and the heat-dissipating body of the third embodiment of the present invention.

The heat-dissipating body 30 can be made by extruding the materials having good heat conductivity and heat-dissipating performance (such as aluminum). The heat-dissipating body has a hollow cylinder 31. The outer periphery of the cylinder 31 is formed with a plurality of radial heat-dissipating pieces 32. The cylinder is used for covering on the heat-releasing end 22 of each heat pipe 20. One side of the cylinder 31 is provided with a solder inlet 33. The solder inlet 33 can be a hole in communication with the interior and exterior of the cylinder 31. The solder inlet 33 of each heat-dissipating body 30 is arranged toward the same direction (as shown in FIG. 6). With the above structure, during the manufacturing process, it is easy to melt the solder (such as tin paste) and the melted solder flows into the gap between the heat pipe 20 and the cylinder 31 and the inner wall of the heat-releasing end 22. Further, the solder inlet 33 can be also a longitudinal hole (as shown in FIG. 9) provided on the inner wall of the cylinder (31). Therefore, the above structure makes the heat-dissipating body 30 to exert an elastic clamping force to the heat pipe 20, thereby to facilitate the assembling of the heat-dissipating body 30 and the heat pipe 20.

The heat-dissipating structure of the present invention can be applied to a LED lamp 5. The LED lamp 5 comprises a LED set 50, a lamp cover 51 covered over the LED set 50 and two power lines 52 electrically connected to the LED set 50. In assembling, the bottom surface of the LED set 50 adheres on the bottom surface of the heat-conducting base 10. Two power lines 52 penetrate through the notches 13 of the heat-conducting base 10, respectively. The lamp cover 51 covers the I-lettered heat pipe 20 with the heat pipe penetrating therethrough, and then is fixedly connected onto the plate 11 of the heat-conducting base 10. Then, each heat-dissipating body 30 is subsequently connected onto the heat-releasing end 22 of the heat pipe 20. The solder inlet 30 of each heat-dissipating body 30 is filled with solder (not shown). Then, by heating, the solder melts and flows into the gap between the heat-releasing end 22 of the heat pipe 20 and the inner wall of the cylinder 31. In this way, a LED lamp can be constructed.

In use, after each power line 52 of the LED lamp 5 is supplied with electric current, the light-emitting diodes of the LED set 50 can emit light and generate heat. With the heat conduction of the heat-conducting base 10, the heat can be transferred to the heat-absorbing end 21 of each heat pipe 20. With the phase change between liquid phase and vapor phase of the working liquid within each heat pipe 20, the generated heat can be rapidly transferred to the outside. By dispersing each heat-dissipating body 30, the heat generated by the light-emitting diodes of the LED set 50 can be dissipated by each heat pipe 20 and heat-dissipating body 30, thereby to perform the heat conduction and dissipation. As a result, the LED set 50 can be continuously operated in a suitable working temperature, so that its life can be elongated.

Figure 7:
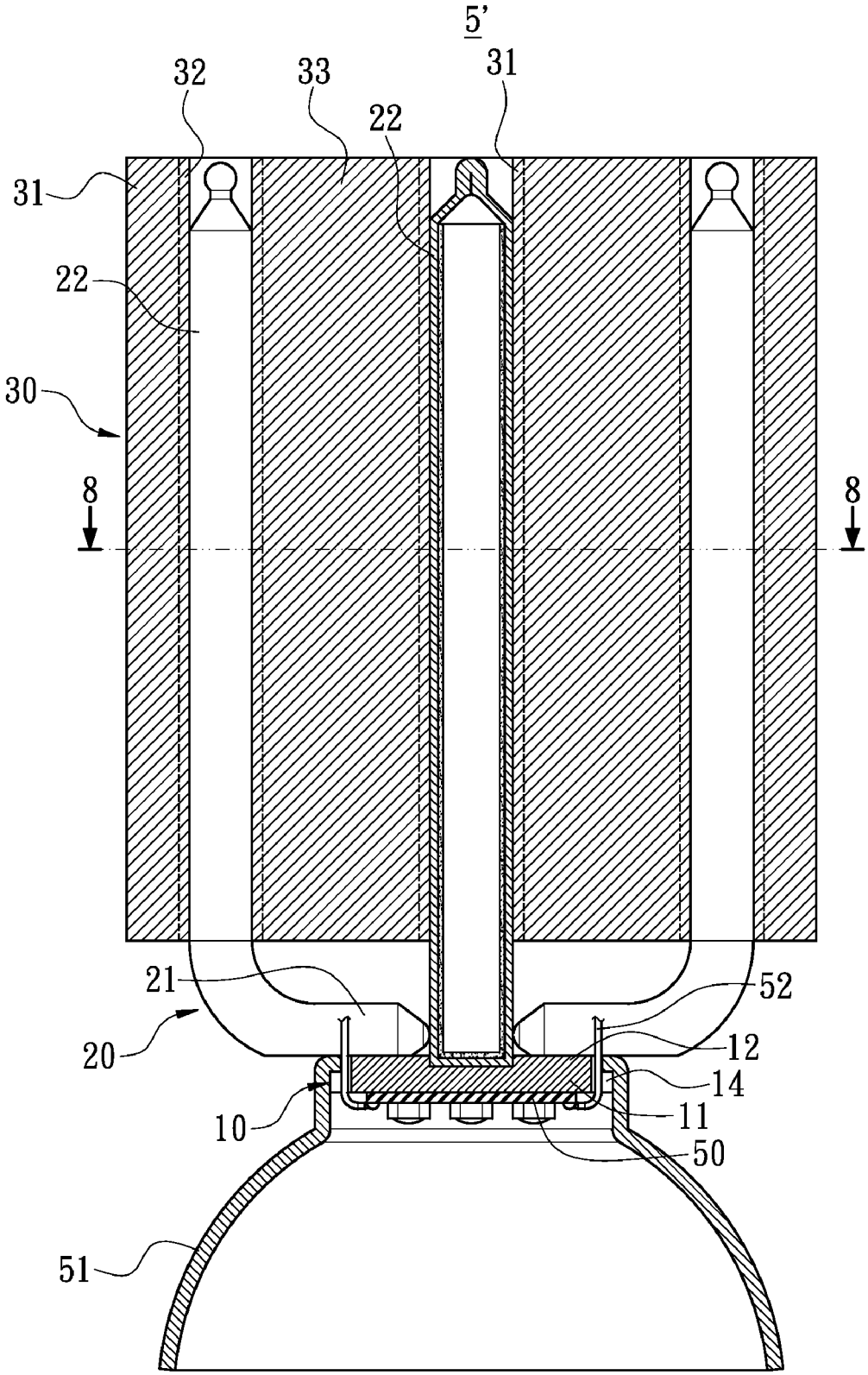
FIG. 7 is a longitudinal cross-sectional view showing the assembling of the second embodiment of the present invention.
Figure 8:
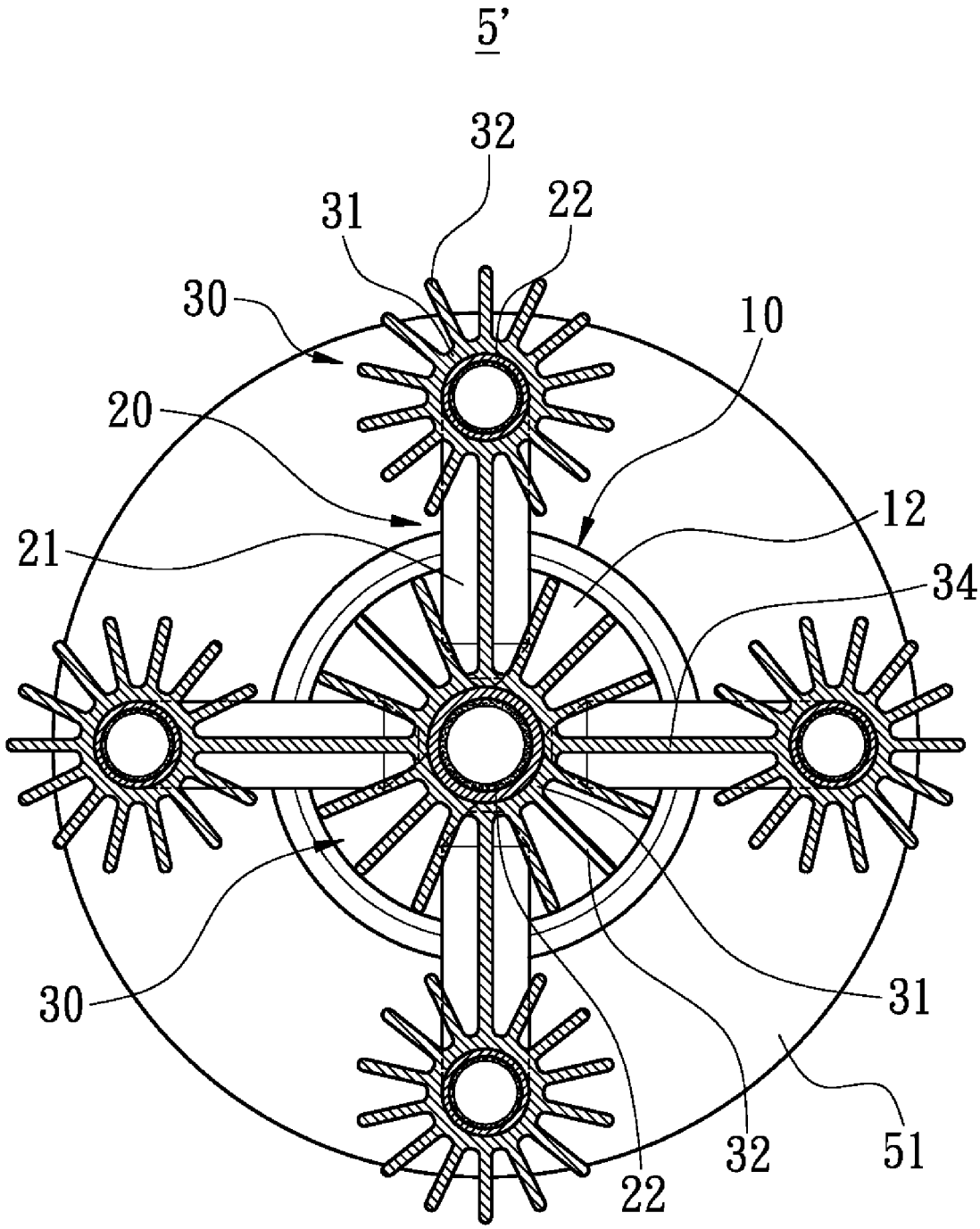
FIG. 8 is a cross-sectional view taken along the line 8-8 of FIG. 7.

FIG. 7 is a longitudinal cross-sectional view showing the assembling of the second embodiment of the present invention, and FIG. 8 is a cross-sectional view taken along the line 8-8 of FIG. 7. In addition to the construction of the above embodiment, an arm 34 is provided to extend between each heat-dissipating body 30, thereby to integrally combine the heat-dissipating bodies 30 with each other. In this way, the whole strength of the structure of the LED lamp 5' can be enhanced.

According to the above, the multiple-set heat-dissipating structure for the LED lamp in accordance with the present invention indeed achieves the desired effects by employing the above-mentioned structure. Further, since the construction of the present invention has not been used in any products of the same kind or in public or published prior to applying for patent. Therefore, the present invention has novelty and inventive steps and completely conforms to the requirements for a utility model patent.

Although the present invention has been described with reference to the foregoing preferred embodiments, it will be understood that the invention is not limited to the details thereof. Various equivalent variations and modifications can still be occurred to those skilled in this art in view of the teachings of the present invention. Thus, all such variations and equivalent modifications are also embraced within the scope of the invention as defined in the appended claims.

What is claimed is:

1. A multiple-set heat-dissipating structure for a light emitting diode (LED) lamp for performing heat dissipation of the LED lamp, comprising:

a heat-conducting base with a base plate adhering to and contacting with the LED lamp and a protruding plate extending upwardly on the base plate, an outer diameter of the protruding plate being slightly smaller than that of the base plate, the LED lamp further having a lamp cover and the heating-conducting base being combined with the lamp cover by fitting the protruding plate in an opening of the lamp cover, wherein a center of the protruding plate is provided with an accommodating hole;

a plurality of heat pipes, each heat pipe having a heat-absorbing end and a heat-releasing end, the heat-absorbing end connected to the protruding base, the heat pipes including one I-shaped heat pipe with the heat-absorbing end to be received in the accommodating hole; and a plurality of heat-dissipating bodies separately formed, each heat-dissipating body having a hollow cylinder with a circular cross section to receive the heat-releasing end of each heat pipe therein and a plurality of radial heat-dissipating pieces extending from an outer periphery of the cylinder.

2. The multiple-set heat-dissipating structure for a LED lamp according to claim 1, wherein outer peripheries of the base plate and the protruding plate of the heat-conducting base are provided with a plurality of notches, the LED lamp has two power lines, and each power line penetrates from the notch to an exterior of the lamp cover.

3. The multiple-set heat-dissipating structure for a LED lamp according to claim 1, wherein the heat pipe is formed into any one a L-lettered or U-lettered shape.

4. The multiple-set heat-dissipating structure for a LED lamp according to claim 1, wherein the cylinder of each heat-dissipating body is provided with a solder inlet thereon.

5. The multiple-set heat-dissipating structure for a LED lamp according to claim 4, wherein the solder inlet is a hole in communication with the interior and exterior of the cylinder.

6. The multiple-set heat-dissipating structure for a LED lamp according to claim 4, wherein the solder inlet is a longitudinal hole provided on the inner wall of the cylinder.

7. The multiple-set heat-dissipating structure for a LED lamp according to claim 4, wherein the solder inlet of each heat-dissipating body is arranged toward the same direction.

* * * * *